US009987862B2

(12) United States Patent
Sano et al.

(10) Patent No.: US 9,987,862 B2
(45) Date of Patent: Jun. 5, 2018

(54) INK-JET RECORDING APPARATUS

(71) Applicant: Brother Kogyo Kabushiki Kaisha, Nagoya-shi, Aichi-ken (JP)

(72) Inventors: Iwane Sano, Obu (JP); Tsuyoshi Ito, Nagoya (JP); Gakuro Kanazawa, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/417,697

(22) Filed: Jan. 27, 2017

(65) Prior Publication Data

US 2017/0217220 A1 Aug. 3, 2017

(30) Foreign Application Priority Data

Jan. 29, 2016 (JP) ..... 2016-016670

(51) Int. Cl.

| | |
|---|---|
| ***B41J 2/01*** | (2006.01) |
| ***B41J 11/04*** | (2006.01) |
| ***B41J 11/00*** | (2006.01) |
| ***B41J 11/06*** | (2006.01) |

(52) U.S. Cl.

CPC ..... *B41J 11/04* (2013.01); *B41J 2/01* (2013.01); *B41J 11/0045* (2013.01); *B41J 11/06* (2013.01)

(58) Field of Classification Search

None

See application file for complete search history.

(56) References Cited

U.S. PATENT DOCUMENTS 9,085,175 B2 * 7/2015 Okuno ..... B41J 11/0065
2013/0257935 A1 * 10/2013 Arakane ..... B41J 2/04508 347/8

FOREIGN PATENT DOCUMENTS

JP 2003-291430 A 10/2003

* cited by examiner

*Primary Examiner* — Matthew Luu
*Assistant Examiner* — Tracey McMillion
(74) *Attorney, Agent, or Firm* — Banner & Witcoff, Ltd.

(57) ABSTRACT

An ink-jet recording apparatus is provided. The ink-jet recording apparatus includes: a plurality of rollers that convey a sheet in a conveyance direction; a platen; a recording unit; a plurality of first ribs provided in the platen; and a plurality of second ribs provided between the first ribs and the rollers in the conveyance direction. The plurality of rollers, the plurality of first ribs, and the plurality of second ribs are each disposed in a position where at least parts of them overlap in the width direction, and a length in the width direction of each of the supporting surfaces of the plurality of second ribs is longer than that in the width direction of each of the supporting surfaces of the plurality of first ribs, and is shorter than that in the width direction of an abutting surface on the sheet in each of the plurality of rollers.

9 Claims, 9 Drawing Sheets

INK-JET RECORDING APPARATUS

CROSS REFERENCE TO RELATED APPLICATION

The present application claims priority from Japanese Patent Application No. 2016-016670 filed on Jan. 29, 2016, the disclosure of which is incorporated herein by reference in its entirety.

FIELD OF THE INVENTION

The present invention relates to an ink-jet recording apparatus that records an image on a sheet by discharging ink droplets from nozzles.

DESCRIPTION OF THE RELATED ART

In an ink-jet recording apparatus, a sheet being conveyed along a conveyance path formed inside the apparatus sometimes ends up floating up from a platen supporting said sheet. When floating-up of the sheet occurs at a position facing a nozzle, a spacing between the sheet and the nozzle ends up changing, and there is a risk that an effect ends up being exerted on image quality of an image recorded on the sheet.

In order to solve such a problem, conventionally, an ink-jet recording apparatus in which high ribs and low ribs that extend along a conveyance direction of the sheet are disposed alternately along a width direction, is known. In a publicly known ink-jet recording apparatus, when an ink droplet discharged from a nozzle adheres to a sheet supported by high ribs and low ribs, said sheet attains a waved state along the width direction. As a result, warping upward of the sheet is reduced, hence a change in spacing between the sheet and the nozzle can be reduced.

SUMMARY

However, according to findings of the inventors, in the above-mentioned ink-jet recording apparatus, the following problem occurs. Said ink-jet recording apparatus includes a roller for conveying the sheet, downstream in the conveyance direction of the platen. A plurality of said rollers are provided along the width direction, at the same positions as the ribs, in the width direction. As a result, a waveform shape of the sheet formed by the ribs is reliably maintained in an entire region of the platen.

A length in the width direction of each of the rollers is longer than a length in the width direction of each of the ribs. Therefore, when the sheet that has the waveform shape formed therein by being supported by the ribs on the platen enters the roller, a wavelength of the waveform shape of the sheet in a portion that has entered the roller in the sheet, suddenly changes. As a result, there is a risk that the waveform shape of not only the portion that has entered the roller in the sheet, but also a portion supported by the ribs in the sheet, is lost. If the waveform shape of the portion supported by the ribs in the sheet is lost, there is a risk of an effect being exerted on the image recorded on the sheet.

The present teaching was made in view of the above-described problem, and has an object of providing an ink-jet recording apparatus capable of favorably maintaining a waveform shape of a sheet on a platen.

According to an aspect of the present teaching, there is provided an ink-jet recording apparatus configured to discharge ink droplets onto a sheet, including:

a plurality of rollers configured to convey the sheet in a conveyance direction, the plurality of rollers being disposed so that each of two adjacent rollers of the plurality of the rollers have a spacing therebetween in a width direction orthogonal to the conveyance direction;

a platen disposed more upstream in the conveyance direction than the plurality of rollers;

a recording unit disposed above the platen and configured to discharge the ink droplets from a plurality of nozzles toward the platen;

a plurality of first ribs provided in the platen, disposed so that each of two adjacent first ribs of the plurality of the first ribs have a spacing therebetween in the width direction, and each having a supporting surface for supporting the sheet; and a plurality of second ribs provided between the plurality of first ribs and the plurality of rollers in the conveyance direction, respectively, disposed so that each of two adjacent second ribs of the plurality of the second ribs have a spacing therebetween in the width direction, and each having a supporting surface for supporting the sheet, wherein at least parts of the plurality of rollers, the plurality of first ribs, and the plurality of second ribs overlap in the width direction, and wherein a length in the width direction of each of the supporting surfaces of the plurality of second ribs is longer than a length in the width direction of each of the supporting surfaces of the plurality of first ribs, and is shorter than a length in the width direction of a contacting surface on the sheet in each of the plurality of rollers.

Due to the present configuration, the waveform shape along the width direction of the sheet formed by the first rib changes gradually as the sheet is conveyed downstream in the conveyance direction to reach the second rib and then reach the roller. As a result, loss of waveform shape when the sheet enters the roller can be reduced. In other words, the waveform shape of the sheet can be favorably maintained on the platen.

BRIEF DESCRIPTION OF THE DRAWINGS

FIGS. 7A and 7B include plan views showing schematically the first rib 91, the second rib 92, the discharge roller 62, and the contacting member 81 in a modified example, wherein FIG. 7A depicts a configuration where the second rib 92 is disposed within an area 94, and FIG. 7B depicts a configuration where a length in a left-right direction 9 of an upper surface 92A of the second rib 92 is longer the further progress is made downstream in a conveyance direction 15.

FIGS. 8A and 8B include plan views showing schematically the first rib 91, the second rib 92, the discharge roller 62, and the contacting member 81 in a modified example, wherein FIG. 8A depicts a configuration where lengths in the left-right direction 9 of the upper surface 91A of the first rib 91 and the upper surface 92A of the second rib 92 are longer the further progress is made downstream in the conveyance direction 15, and FIG. 8B depicts a configuration where the first rib 91 and the second rib 92 are joined.

DESCRIPTION OF THE EMBODIMENTS

Figure 1:
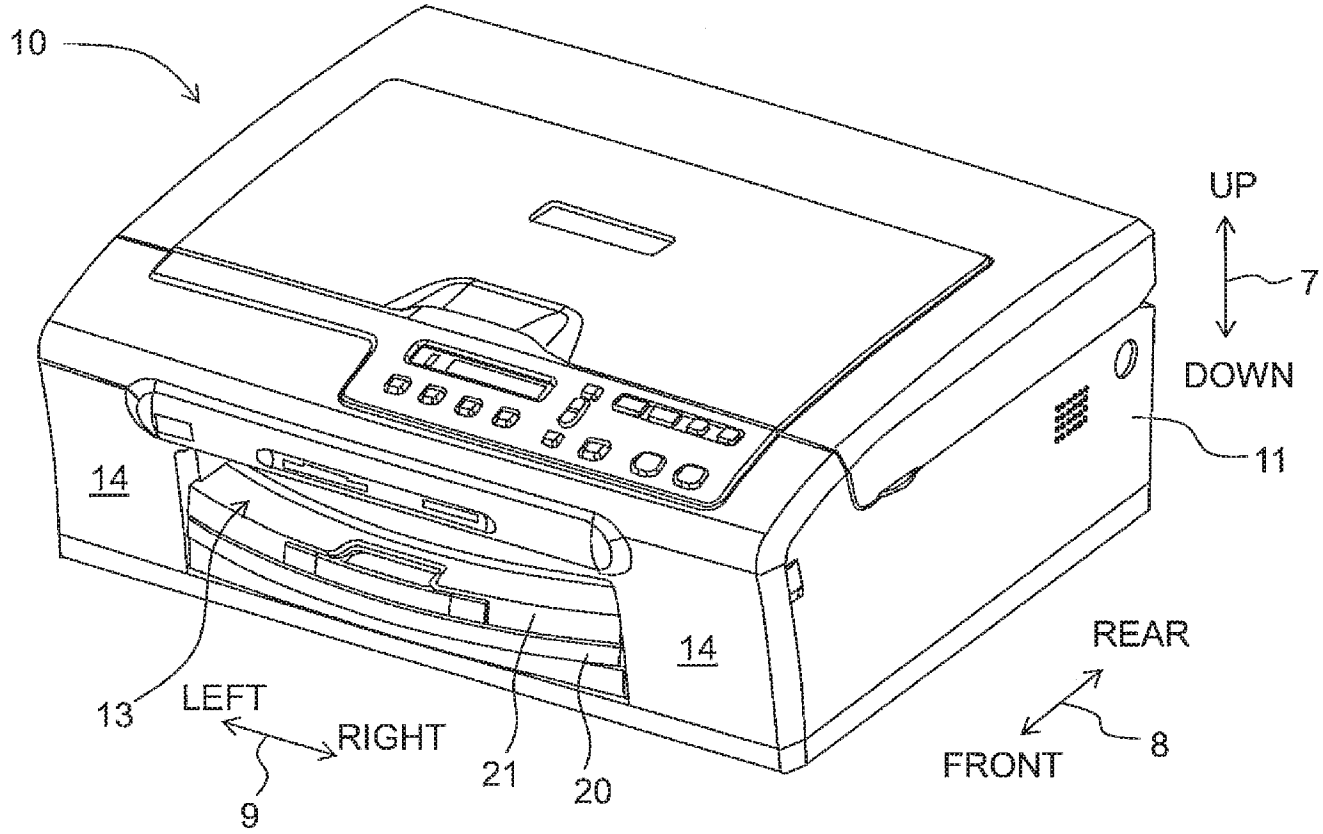
FIG. 1 is a perspective view of a multifunction peripheral 10 which is an example of an embodiment of the present invention.

An embodiment of the present teaching will be described below. Note that the embodiment described below is merely an example of the present teaching, and it goes without saying that the embodiment of the present teaching may be appropriately changed in a range that does not alter the gist of the present teaching. Moreover, in the description below, an up-down direction 7 is defined with reference to a state in which a multifunction peripheral 10 is usably disposed (state of FIG. 1), a front-rear direction 8 is defined assuming a surface provided with an opening 13 to be a front surface 14, and a left-right direction 9 is defined viewing the multifunction peripheral 10 from the front. The up-down direction 7, the front-rear direction 8, and the left-right direction 9 are orthogonal to each other.

[Overall Structure of Multifunction Peripheral 10]

As depicted in FIG. 1, the multifunction peripheral 10 (an example of an ink-jet recording apparatus) is roughly formed into a thin type rectangular parallelepiped. A printer unit 11 is provided in a lower part of the multifunction peripheral 10. The multifunction peripheral 10 has various functions such as a facsimile function and a print function. As the print function, the multifunction peripheral 10 has a function of recording an image on one surface of a sheet 12 (refer to FIG. 2, an example of a sheet) by an ink-jet system. Note that the multifunction peripheral 10 may record an image on one surface and both surfaces of the sheet 12.

[Feed Tray 20]

Figure 2:
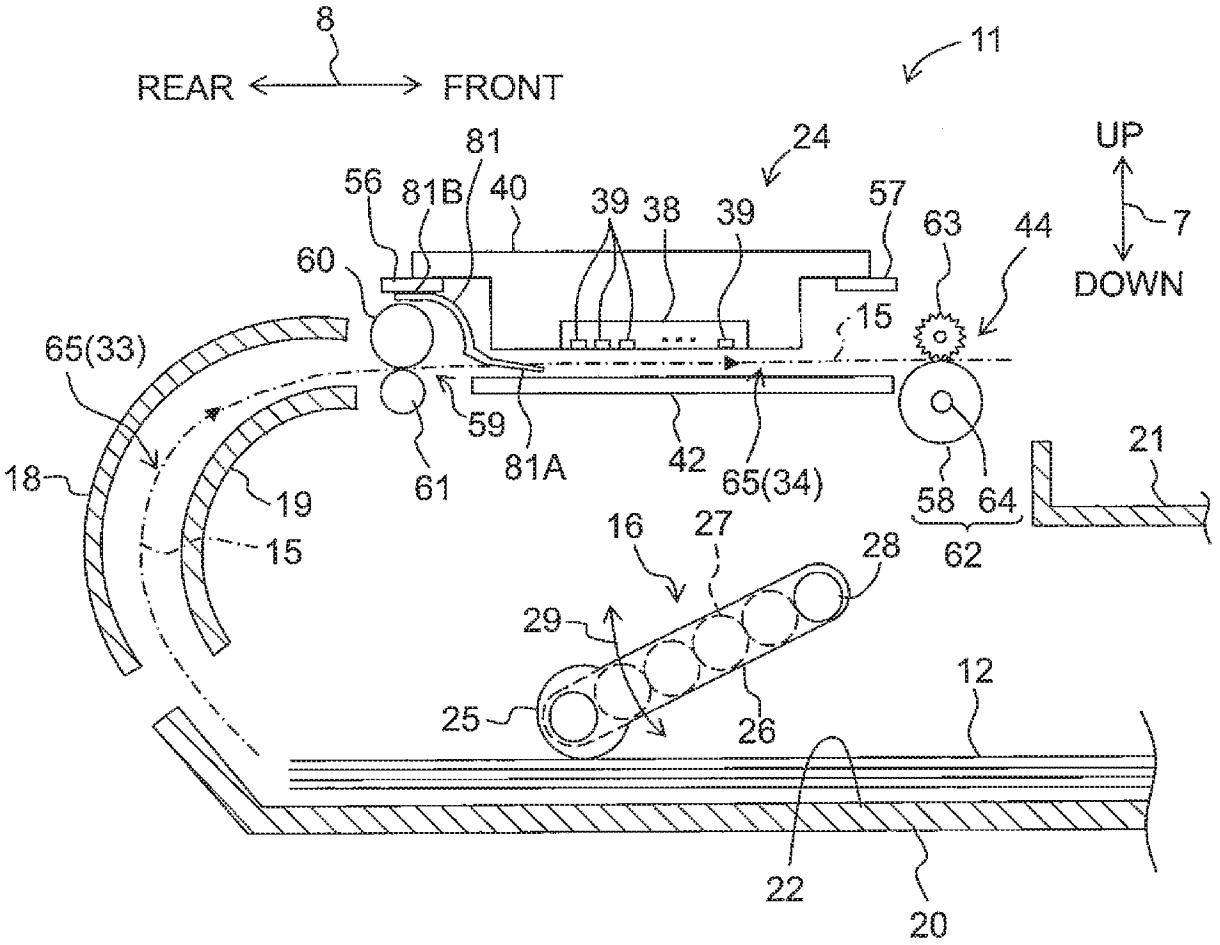
FIG. 2 is a longitudinal cross-sectional view showing schematically an internal structure of a printer unit 11.

As depicted in FIG. 1, the opening 13 is formed in a front surface of the printer unit 11. The feed tray 20 is movable in the front-rear direction 8. In other words, the feed tray 20 is insertable into and removable from the printer unit 11 via the opening 13. The feed tray 20 is a box-shaped member which is open at its upper side. As depicted in FIG. 2, sheets 12 are supported in a stacked state on a bottom plate 22 of the feed tray 20. A discharge tray 21 is supported above a front part of the feed tray 20. The discharge tray 21 moves in the front-rear direction 8 integrally with the feed tray 20. The sheet 12 on which an image is recorded by a recording unit 24, is discharged onto an upper surface of the discharge tray 21. Note that the discharge tray 21 may be supported by the printer unit 11.

[Feed Unit 16]

As depicted in FIG. 2, a feed unit 16 is disposed below the recording unit 24. The feed unit 16 includes a feed roller 25, a feed arm 26, a drive transmitting mechanism 27, and a shaft 28. The feed roller 25 is rotatably supported by a distal end of the feed arm 26. The feed arm 26 pivots in directions of an arrow 29, with the shaft 28 disposed at a basal end of the feed arm 26 as a center. As a result, the feed roller 25 is capable of abutting on and separating from the feed tray 20 or the sheet 12 supported by the feed tray 20.

The feed roller 25 rotates by a driving force of a feed motor (not illustrated) being transmitted to the feed roller 25 by the drive transmitting mechanism 27 which is configured by a plurality of gears being meshed with each other. As a result, an uppermost sheet 12 abutting on the feed roller 25, of the sheets 12 supported by the bottom plate 22 of the feed tray 20 is fed to a conveyance path 65. Note that the drive transmitting mechanism 27 is not limited to a gear mechanism in which a plurality of gears are meshed with each other. For example, the drive transmitting mechanism 27 may be a belt stretched between the shaft 28 and a shaft of the feed roller 25.

[Conveyance Path 65]

As depicted in FIG. 2, the conveyance path 65 is extended out from a rear end of the feed tray 20. The conveyance path 65 includes a curved part 33 and a linear part 34. The curved part 33 extends upwardly making a U-turn from a rearward direction to a frontward direction. The linear part 34 roughly extends along the front-rear direction 8.

The curved part 33 is formed by an outer guide member 18 and an inner guide member 19 facing each other separated by a certain spacing. Each of the guide members 18, 19 extends in the left-right direction 9 (an example of a width direction) which is a direction orthogonal to a plane of paper in FIG. 2. The linear part 34 is formed by a conveyance roller pair 59, the recording unit 24 and a platen 42 that face each other separated by a certain spacing, and a discharge roller pair 44.

The sheet 12 supported by the feed tray 20 is conveyed along the curved part 33 by the feed roller 25 to reach the conveyance roller pair 59. The sheet 12 sandwiched by the conveyance roller pair 59 is conveyed frontwards toward the recording unit 24, along the linear part 34. The sheet 12 that has reached directly below the recording unit 24 has an image recorded thereon by the recording unit 24. The sheet 12 on which the image has been recorded is conveyed frontwards along the linear part 34 to be discharged on the discharge tray 21. As described above, the sheet 12 is conveyed along a conveyance direction 15 indicated by arrows of a dot-chain line in FIG. 2.

[Recording Unit 24]

As depicted in FIG. 2, the recording unit 24 is disposed above the linear part 34. The platen 42 supporting the sheet 12 conveyed in the conveyance direction 15 along the linear part 34 of the conveyance path 65 is disposed in a position below the linear part 34 and facing the recording unit 24.

The recording unit 24 includes a carriage 40 and a recording head 38. The carriage 40 is supported by two guide rails 56, 57 which are disposed with a spacing therebetween in the front-rear direction 8, and is movable over the guide rails 56, 57 along the left-right direction 9. The guide rail 56 is disposed more upstream in the conveyance direction 15 than the recording head 38. The guide rail 57 is disposed more downstream in the conveyance direction 15 than the recording head 38. The guide rails 56, 57 are supported by a pair of side frames (not illustrated) disposed outwardly of the linear part 34 of the conveyance path 65 in the left-right direction 9. The carriage 40 moves by being applied with a drive force from a carriage drive motor (not illustrated).

The recording head 38 is mounted in the carriage 40. The recording head 38 is supplied with ink from an ink cartridge (not illustrated). A plurality of nozzles 39 are formed in a lower surface of the recording head 38. When the carriage 40 is moving in the left-right direction 9, the recording head 38 discharges an ink droplet from the nozzle 39, toward the platen 42. As a result, the sheet 12 conveyed in the conveying orientation 15 along the linear part 34 to be supported by the platen 42, is recorded with an image.

[Conveyance Roller Pair 59 and Discharge Roller Pair 44]

As depicted in FIG. 2, the conveyance roller pair 59 is disposed more upstream in the conveyance direction 15 than the recording head 38 in the linear part 34. The discharge roller pair 44 is disposed more downstream in the conveyance direction 15 than the recording head 38 in the linear part 34.

Figure 3:
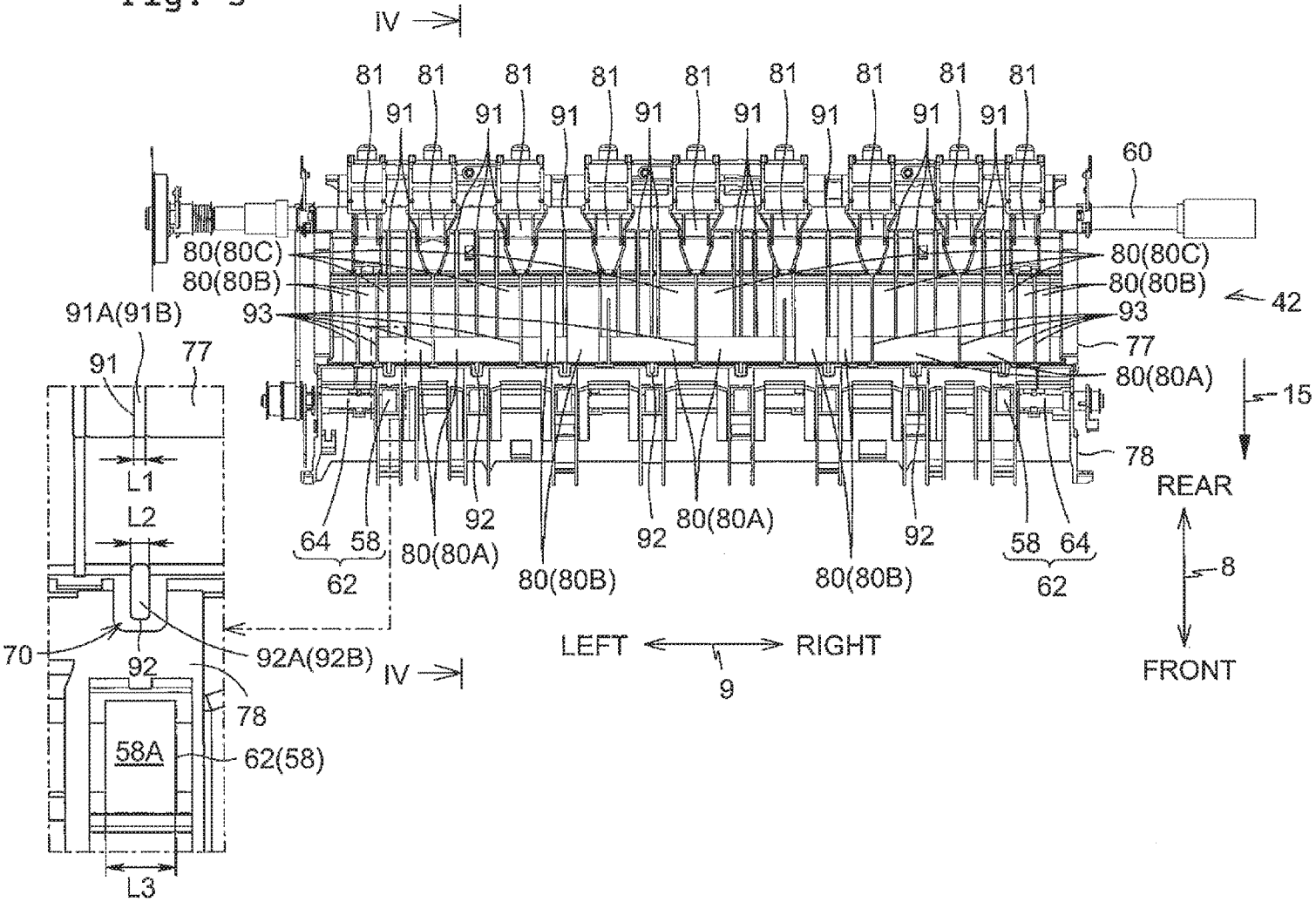
FIG. 3 is a plan view showing a platen 42, an contacting member 81, a conveyance roller 60, and a discharge roller 62.

The conveyance roller pair 59 includes: a conveyance roller 60; and a pinch roller 61 which is disposed below the conveyance roller 60 so as to face the conveyance roller 60. As depicted in FIG. 3, the conveyance roller 60 is a cylindrical member extending in the left-right direction 9. The conveyance roller 60 is rotatably supported by a pair of side frames of the multifunction peripheral 10 (not illustrated). A plurality of the pinch rollers 61 are provided, respectively disposed with a spacing between them in the left-right direction 9. Each of the pinch rollers 61 is pressed toward the conveyance roller 60 by an elastic member (not illustrated) such as a coil spring.

A surface 60A (refer to FIG. 4) of the conveyance roller 60 abuts on a first surface (surface facing the recording unit 24) of the sheet 12 and surfaces 61A (refer to FIG. 4) of each of the pinch rollers 61 abut on a second surface (surface opposite the first surface) of the sheet 12. As a result, the conveyance roller pair 59 can sandwich the sheet 12.

Figure 4:
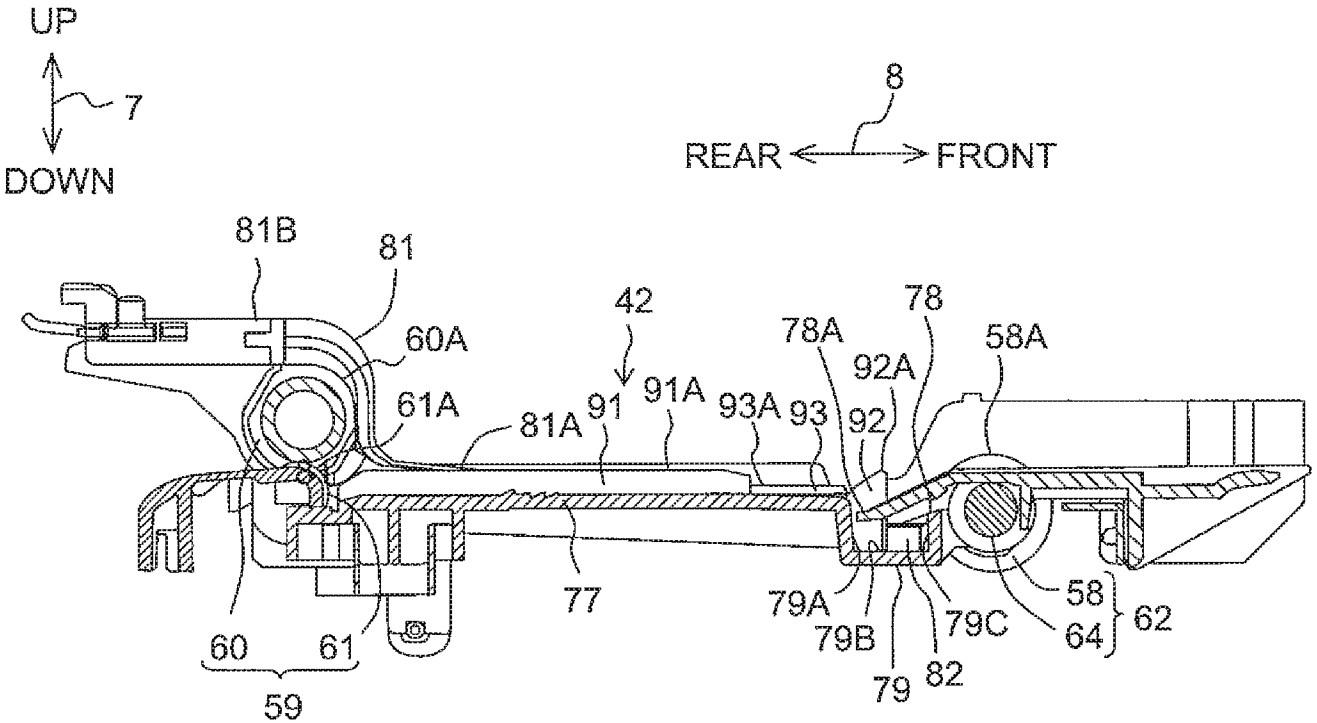
FIG. 4 is a cross-sectional view taken along the line IV-IV of FIG. 3.

As depicted in FIG. 2, the discharge roller pair 44 includes: a discharge roller 62; and a spur roller 63 which is disposed above the discharge roller 62 so as to face the discharge roller 62. As depicted in FIG. 3, the discharge roller 62 includes: a shaft 64 extending in the left-right direction 9 orthogonal to the conveyance direction 15; and a plurality of roller parts 58 (an example of a plurality of rollers) each attached to the shaft 64 so as to surround it, respectively having a spacing between them in the left-right direction 9. The discharge roller 62 is rotatably supported by a pair of side frames (not illustrated). A plurality of the spur rollers 63 depicted in FIG. 2 are provided, respectively disposed with a spacing between them in the left-right direction 9. Each of the spur rollers 63 is disposed facing each of the roller parts 58 in the left-right direction 9. Each of the spur rollers 63 is pressed toward each of the roller parts 58 by an elastic member (not illustrated) such as a coil spring. Note that in FIGS. 3 and 4, illustration of the spur roller 63 is omitted.

Surfaces 58A (an example of abutting surfaces, refer to FIG. 4) of each of the roller parts 58 of the discharge roller 62 abut on the second surface of the sheet 12, and tips of teeth of gear wheels configuring each of the spur rollers 63 abut on the first surface of the sheet 12. As a result, the discharge roller pair 44 can sandwich the sheet 12.

The conveyance roller 60 and the discharge roller 62 rotate by a drive force from a conveyance motor (not illustrated). When the conveyance roller 60 rotates in a state that the sheet 12 is sandwiched by the conveyance roller pair 59, said sheet 12 is conveyed in the conveyance direction 15 by the conveyance roller pair 59 and conveyed onto the platen 42. When the discharge roller 62 rotates in a state that the sheet 12 is sandwiched by the discharge roller pair 44, the sheet 12 is conveyed in the conveyance direction 15 by the discharge roller pair 44 and discharged onto the discharge tray 21.

[Contacting Member 81]

As depicted in FIG. 2, a contacting member 81 is disposed more upstream in the conveyance direction 15 than the nozzle 39 formed in the recording head 38. The contacting member 81 is molded by a synthetic resin (for example, polyacetal (POM)). Note that the contacting member 81 may be configured by a plurality of members being combined. For example, a plurality of members can be combined by the engagement.

As depicted in FIG. 3, a plurality of the contacting members 81 are provided, respectively disposed with a spacing between them in the left-right direction 9. In the present embodiment, the number of contacting members 81 is nine, but the number of the contacting member 81 may be other than nine.

Each of the contacting members 81 has its upstream end 81B in the conveyance direction 15 attached to the guide rail 56 by a publicly known means such as engagement.

Each of the contacting members 81 curves downwards and frontwards from the upstream end 81B. As a result, each of the contacting members 81 is provided extending to an upstream vicinity in the conveyance direction 15 of the nozzle 39 disposed most upstream, of the plurality of nozzles 39. Moreover, each of the contacting members 81 is provided extending toward the platen 42 in the up-down direction 7. A downstream end 81A (an example of a contacting section, refer to FIG. 2) in the conveyance direction 15 of each of the contacting members 81 can abut or contact on an upper surface of the sheet 12 supported by the platen 42.

[Platen 42]

As depicted in FIG. 2, the platen 42 is disposed between the conveyance roller pair 59 and the discharge roller pair 44 in the linear part 34 of the conveyance path 65.

As depicted in FIG. 4, the platen 42 includes a main body 77, a housing 79, a first rib 91, a second rib 92, and a third rib 93. The main body 77 is configured in a plate shape. The housing 79 is a portion for housing an ink absorbing material 82 that absorbs ink, and is extended out downstream in the conveyance direction 15 from the main body 77. The first rib 91, the second rib 92, and the third rib 93 support the sheet 12. The first rib 91 and the third rib 93 are projected upwardly from the main body 77 and are extended out along the conveyance direction 15. The second rib 92 is projected upwardly and downstream in the conveying orientation 15 from a downstream edge of the main body 77.

As depicted in FIGS. 3 and 4, the main body 77 is a plate-shaped member whose lengths in the left-right direction 9 and the front-rear direction 8 are longer than its length in the up-down direction 7. The length in the left-right direction 9 of the main body 77 is longer than its length in the front-rear direction 8. The main body 77 is disposed facing the nozzle 39 formed in the recording head 38.

As depicted in FIG. 3, an upper surface 80 of the main body 77 is a surface extending in the front-rear direction 8 and the left-right direction 9. The upper surface 80 includes a first area 80A, a second area 80B, and a third area 80C. The first area 80A is an area positioned directly below a periphery of an end in the conveyance direction 15 of the sheet 12 when a so-called borderless printing where the recording unit 24 discharges an ink droplet to an edge of the sheet 12 is executed. The second area 80B is an area positioned directly below a periphery of a right end and a left end of the sheet 12 of various kinds of sizes that are printable in the multifunction peripheral 10, when the borderless printing is executed. The third area 80C is an area positioned other than directly below the end in the conveyance direction 15 and the right end and left end of the sheet 12, when the borderless printing is executed. When the borderless printing is executed, the ink droplet is impacted on and adheres to part of the first area 80A and the second area 80B (a portion where the sheet 12 is not supported).

The first area 80A is an area more downstream in the conveyance direction 15 than the third area 80C. An upstream end in the conveyance direction 15 of the first area 80A is positioned between the nozzle 39 positioned most upstream and the nozzle 39 positioned most downstream in the conveyance direction 15, of the plurality of nozzles 39 of the recording head 38. A downstream end in the conveyance direction 15 of the first area 80A is in substantially the same position as the nozzle 39 positioned most downstream in the conveyance direction 15, of the plurality of nozzles 39 of the recording head 38.

An upstream end in the conveyance direction 15 of the second area 80B is positioned more upstream in the conveyance direction 15 than the nozzle 39 of the recording head 38. A downstream end in the conveyance direction 15 of the second area 80B is in substantially the same position as a position 71 of the nozzle 39 positioned most downstream in the conveyance direction 15, of the plurality of nozzles 39 of the recording head 38.

An upstream end in the conveyance direction 15 of the third area 80C is positioned more upstream in the conveyance direction 15 than the nozzle 39 of the recording head 38. A downstream end in the conveyance direction 15 of the third area 80C is positioned between the nozzle 39 positioned most upstream in the conveyance direction 15 and the nozzle 39 in the most downstream position 71, of the plurality of nozzles 39 of the recording head 38.

The first rib 91, the second rib 92, and the third rib 93 support the sheet 12 by their upper surfaces 91A, 92A, and 93A (refer to FIG. 4) contacting from below on the second surface of the sheet 12. As a result, there is a reduction in ink that has adhered to the first area 80A and the second area 80B adhering to a lower surface of the sheet 12. The first rib 91, the second rib 92, and the third rib 93 will be described later.

As depicted in FIG. 4, the housing 79 is extended out from a downstream edge in the conveyance direction 15 of the main body 77. The housing 79 includes a recess partitioned by a side surface 79A, a bottom surface 79B, and a side surface 79C. The side surface 79A extends downwardly from a downstream edge in the conveyance direction 15 of the main body 77. The bottom surface 79B extends in the conveyance direction 15 from a lower edge of the side surface 79A. The side surface 79C extends upwardly from a downstream edge in the conveyance direction 15 of the bottom surface 79B. The side surfaces 79A, 79C are surfaces extending in the up-down direction 7 and the left-right direction 9. The bottom surface 79B is a surface extending in the front-rear direction 8 and the left-right direction 9. The ink absorbing material 82 is housed in the housing 79. The ink absorbing material 82 is a porous material such as foamed polyurethane.

The upper surface 80 of the main body 77 inclines slightly downwardly in the conveyance direction 15. As a result, ink that has adhered to the upper surface 80 (first area 80A and second area 80B) flows in the conveyance direction 15. Ink that has reached a downstream edge in the conveyance direction 15 of the upper surface 80 flows along the side surface 79A, is led to the ink absorbing material 82, and is absorbed by the ink absorbing material 82.

[Downstream Supporting Portion 78]

As depicted in FIGS. 3 and 4, a downstream supporting portion 78 is provided more downstream in the conveyance direction 15 than the platen 42, with a spacing between itself and the platen 42. The downstream supporting portion 78 is a plate-shaped member whose lengths in the front-rear direction 8 and the left-right direction 9 are longer than its length in the up-down direction 7. The length in the left-right direction 9 of the downstream supporting portion 78 is longer than its length in the front-rear direction 8. The downstream supporting portion 78 is supported by a pair of side frames at its right end and its left end. The downstream supporting portion 78 is a member that supports the sheet 12 conveyed from the platen 42 to guide the sheet 12 toward the discharge roller pair 44.

As depicted in FIG. 4, an upstream end 78A in the conveyance direction 15 of the downstream supporting portion 78 is positioned above the housing 79 of the platen 42. In addition, an upstream edge in the conveyance direction 15 of the downstream supporting portion 78 faces a downstream edge in the conveyance direction 15 of the main body 77 of the platen 42, with a spacing in the conveyance direction 15 between the edges. Ink that has adhered to the first area 80A and the second area 80B of the upper surface 80 of the platen 42 is led to the housing 79 from a gap between the platen 42 and the downstream supporting portion 78.

As depicted in FIG. 3, a recess 70 receding in the conveyance direction 15 is formed in the upstream edge in the conveyance direction 15 of the downstream supporting portion 78. The gap in the conveyance direction 15 between the platen 42 and the downstream supporting portion 78 is large at a place where the recess 70 is formed. As will be described later, the second rib 92 is positioned within the recess 70.

[First Rib 91]

As depicted in FIG. 3, the first rib 91 is formed on the upper surface 80 of the main body 77. The first rib 91 extends along the conveyance direction 15, from an upstream edge to a downstream edge in the conveyance direction 15 of the third area 80C.

A plurality of the first ribs 91 are provided, respectively disposed with a spacing between them in the left-right direction 9. Each of the first ribs 91 is positioned between a right edge and a left edge of each of the roller parts 58 of the discharge roller 62. Note that part of each of the first ribs 91 may be positioned more rightward than the right edge of each of the roller parts 58 or more leftward than the left edge of each of the roller parts 58. In other words, each of the first ribs 91 need only be provided at a position where at least part of it overlaps each of the roller parts 58 in the left-right direction 9. In other words, each of the first ribs 91 need only be provided such that at least part of it overlaps each of the roller parts 58, when viewed from the front-rear direction 8.

Moreover, each of the first ribs 91 is formed between the downstream ends 81A of the plurality of contacting members 81 adjacent in the left-right direction 9.

Each of the first ribs 91 supports the sheet 12 at its upper surface 91A. As depicted in FIG. 4, the upper surface 91A of each of the first ribs 91 is positioned more downwardly than an upper edge of the surface 58A of each of the roller parts 58 of the discharge roller 62.

Figure 5:
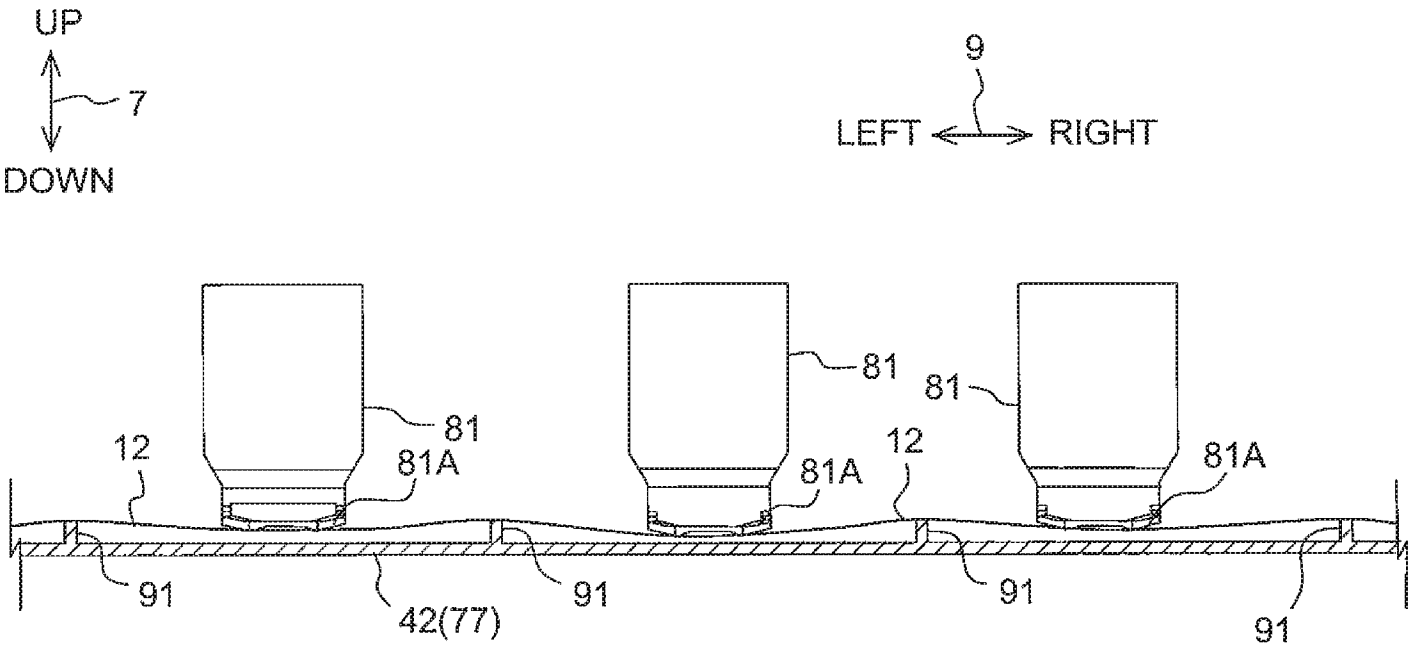
FIG. 5 is a cross-sectional view showing schematically the platen 42, the contacting member 81, and a sheet 12.

Moreover, the upper surface 91A of each of the first ribs 91 is positioned more upwardly than a place where the downstream end 81A of the contacting member 81 abuts or contacts on the upper surface of the sheet 12. As depicted in FIG. 5, due to each of the first ribs 91 being configured as above, the sheet 12 supported by the upper surfaces 91A of each of the first ribs 91 and abutted on by the downstream ends 81A of each of the contacting members 81 is made into a waveform shape continuous in the left-right direction 9. In other words, each of the first ribs 91 cooperates with the downstream end 81A of each of the contacting members 81 by supporting the sheet 12, thereby giving the sheet 12 a waveform shape along the left-right direction 9.

[Second Rib 92]

As depicted in FIG. 3, the second rib 92 is extended out downstream in the conveyance direction 15 from the downstream edge of the main body 77. In other words, the second rib 92 is disposed more downstream in the conveyance direction 15 than the first rib 91, with a spacing in the conveyance direction 15 between itself and the first rib 91. Describing this yet another way, the second rib 92 is disposed more downstream in the conveyance direction 15 than the nozzle 39.

Moreover, the second rib 92 is disposed more upstream in the conveyance direction 15 than the roller part 58 of the discharge roller 62. From the above, the second rib 92 is provided between the plurality of first ribs 91 and the plurality of roller parts 58 in the conveyance direction 15.

A plurality of the second ribs 92 are provided, respectively disposed with a spacing between them in the left-right direction 9. Each of the second ribs 92 is positioned within the recess 70 of the downstream supporting portion 78.

Each of the second ribs 92 is positioned between the right edge and the left edge of each of the roller parts 58 of the discharge roller 62. Note that part of each of the second ribs 92 may be positioned more rightward than the right edge of each of the roller parts 58 or more leftward than the left edge of each of the roller parts 58. In other words, each of the second ribs 92 need only be provided at a position where at least part of it overlaps each of the roller parts 58 in the left-right direction 9. In other words, each of the second ribs 92 need only be provided such that at least part of it overlaps each of the roller parts 58, when viewed from the front-rear direction 8.

Each of the first ribs 91 is positioned between a right edge and a left edge of each of the second ribs 92. Note that part of each of the first ribs 91 may be positioned more rightward than the right edge of each of the second ribs 92 or more leftward than the left edge of each of the second ribs 92. In other words, each of the second ribs 92 need only be provided at a position where at least part of it overlaps each of the first ribs 91 in the left-right direction 9. In other words, each of the second ribs 92 need only be provided such that at least part of it overlaps each of the first ribs 91, when viewed from the front-rear direction 8.

Each of the second ribs 92 supports the sheet 12 at its upper surface 92A. As depicted in FIG. 4, the upper surface 92A of each of the second ribs 92 has substantially the same height as the upper surface 91A of each of the first ribs 91, but may be positioned more downwardly than the upper surface 91A of each of the first ribs 91. Moreover, the upper surface 92A of each of the second ribs 92 is positioned more downwardly than the upper edge of the surface 58A of each of the roller parts 58 of the discharge roller 62.

[Third Rib 93]

As depicted in FIG. 3, the third rib 93 is formed on the upper surface 80 of the main body 77. The third rib 93 is provided in the first area 80A and the second area 80B. The third rib 93 extends along the conveyance direction 15, from an upstream edge to a downstream edge of the first area 80A, in the conveyance direction 15. In other words, the third rib 93 is provided between the first rib 91 and the second rib 92 in the conveyance direction 15.

A plurality of the third ribs 93 are formed with a spacing between them in the left-right direction 9. Each of the third ribs 93 is provided between adjacent first ribs 91 and between adjacent second ribs 92, in the left-right direction 9. Moreover, each of the third ribs 93 is positioned between a right edge and a left edge of the downstream end 81A of each of the contacting members 81. Note that part of each of the third ribs 93 may be positioned more rightward than the right edge of each of the downstream ends 81A or more leftward than the left edge of each of the downstream ends 81A.

Each of the third ribs 93 supports the sheet 12 at its upper surface 93A. As depicted in FIG. 4, the upper surface 93A of each of the third ribs 93 is positioned more downwardly than the upper surface 91A of each of the first ribs 91 and the upper surface 92A of each of the second ribs 92.

[Length in Left-Right Direction 9 of First Rib 91, Second Rib 92, and Roller Part 58]

As depicted in FIG. 3, a length L2 in the left-right direction 9 of a supporting surface 92B of the sheet 12 in each of the second ribs 92 is longer than a length L1 in the left-right direction 9 of a supporting surface 91B of the sheet 12 in each of the first ribs 91. Moreover, a length L3 in the left-right direction 9 of the surface 58A of each of the roller parts 58 of the discharge roller 62 is longer than the length L2 in the left-right direction 9 of the supporting surface 92B of each of the second ribs 92.

The supporting surface 91B is defined as a portion abutted on by the sheet 12, of the upper surface 91A of each of the first ribs 91. The length L1 in the left-right direction 9 of the supporting surface 91B is a distance (length in the left-right direction 9) between a right edge and a left edge in a portion where the sheet 12 and the supporting surface 91B abut on each other.

The supporting surface 92B is a portion abutted on by the sheet 12, of the upper surface 92A of each of the second ribs 92. The length L2 in the left-right direction 9 of the supporting surface 92B is a distance (length in the left-right direction 9) between a right edge and a left edge in a portion where the sheet 12 and the supporting surface 92B abut on each other.

Figure 6A:
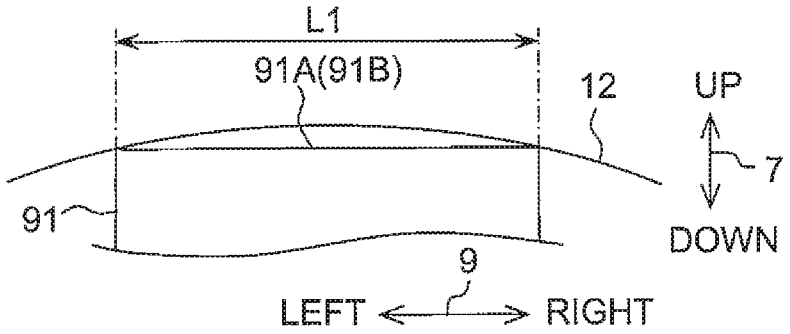
FIG. 6A is a cross-sectional view showing schematically a first rib 91 whose upper surface 91A is a plane surface, and the sheet 12.

For example, as depicted in FIG. 6A, when the upper surface 91A of the first rib 91 is a plane surface and the sheet 12 abuts on only the right end and the left end of the upper surface 91A and does not abut on a middle part of the upper surface 91A, the length in the left-right direction 9 of the supporting surface 91B is a length indicated by L1 in FIG. 6A. In other words, in this case, the length in the left-right direction 9 of the upper surface 91A and the length L1 in the left-right direction 9 of the supporting surface 91B are identical. The same applies also to the upper surface 92A of the second rib 92.

Figure 6B:
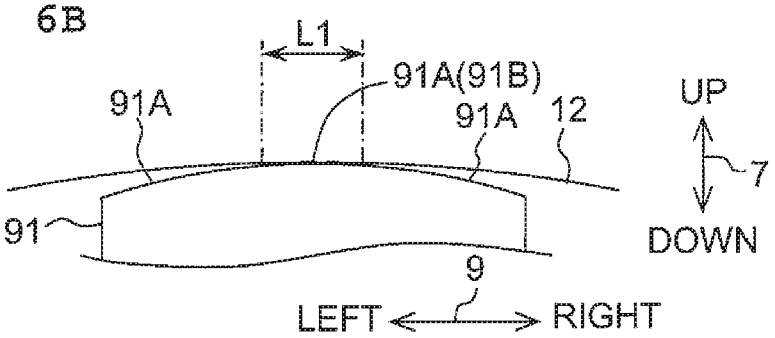
FIG. 6B is a cross-sectional view showing schematically a first rib 91 whose upper surface 91A is a curved surface, and the sheet 12.

Moreover, for example, as depicted in FIG. 6B, when the upper surface 91A of the first rib 91 is a curved surface and the sheet 12 abuts on only the middle part of the upper surface 91A and does not abut on the right end and the left end of the upper surface 91A, the length in the left-right direction 9 of the supporting surface 91B is the length between the right edge and the left edge of the portion where the supporting surface 91A and the sheet 12 abut on each other. In other words, it is a length indicated by L1 in FIG. 6B. In other words, in this case, the length in the left-right direction 9 of the upper surface 91A is longer than the length L1 in the left-right direction 9 of the supporting surface 91B. The same applies also to the upper surface 92A of the second rib 92.

Figure 6C:
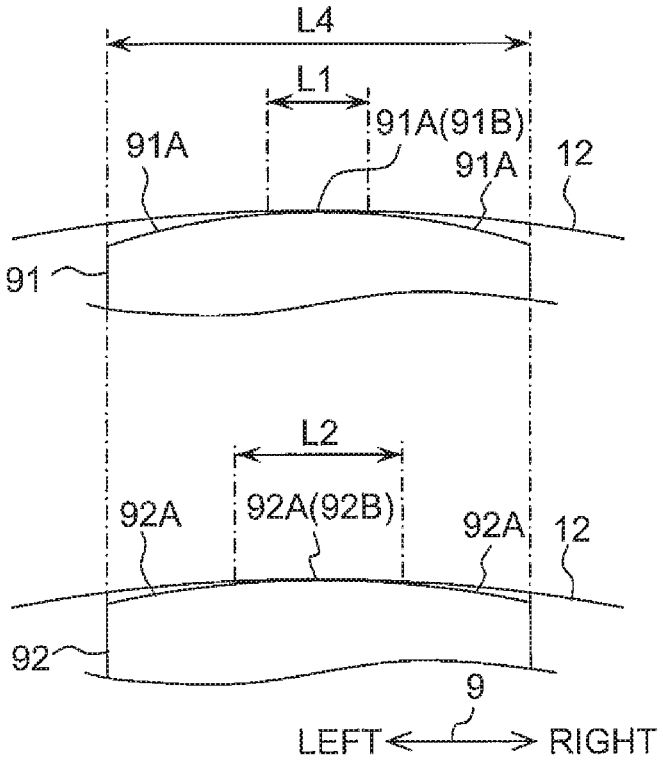
FIG. 6C is a cross-sectional view showing schematically the first rib 91, a second rib 92, and the sheet 12.

Moreover, for example, as depicted in FIG. 6C, when the length in the left-right direction 9 of the upper surface 91A of the first rib 91 and the length in the left-right direction 9 of the upper surface 92A of the second rib 92 are equal, both being a length indicated by L4, and a radius of curvature of the upper surface 92A of the second rib 92 is larger than a radius of curvature of the upper surface 91A of the first rib 91, the length in the left-right direction 9 of the supporting surface 91B is a length indicated by L1, and the length in the left-right direction 9 of the supporting surface 92B is a length indicated by L2. In this case, the length L2 in the left-right direction 9 of the supporting surface 92B of the second rib 92 is longer than the length L1 in the left-right direction 9 of the supporting surface 91B of the first rib 91.

Note that the lengths in the left-right direction 9 of the supporting surfaces 91B, 92B may be different lengths according to the likes of a curved state of the sheet 12, a spacing in the left-right direction 9 of each of the ribs 91, a spacing in the left-right direction 9 of each of the ribs 92, a spacing in the left-right direction 9 between each of the ribs 91, 92 and the downstream end 81A of each of the contacting members 81, a length in the up-down direction 7 between an upper edge of each of the ribs 91, 92 and a lower edge of the downstream end 81A of each of the contacting members 81, shapes of the upper surfaces 91A, 92A of each of the ribs 91, 92, and so on.

The surface 58A is a surface abutted on by the sheet 12 in each of the roller parts 58. The length L3 in the left-right direction 9 of the surface 58A is a length from a right edge to a left edge of a surface facing outwardly in a radial direction of each of the roller parts 58.

Effects of Embodiment

Due to the present embodiment, the length L2 in the left-right direction 9 of the upper surface 92A of each of the second ribs 92 is longer than the length L1 in the left-right direction 9 of the upper surface 91A of each of the first ribs 91 and shorter than the length L3 in the left-right direction 9 of the surface 58A of each of the roller parts 58 of the discharge roller 62. Therefore, the waveform shape along the left-right direction 9 of the sheet 12 formed by the first rib 91 gradually changes as the sheet 12 is conveyed downstream in the conveyance direction 15 to reach the second rib 92 and then reach the roller part 58. As a result, loss of the waveform shape during entry to the roller part 58 of the sheet 12 can be reduced.

Moreover, due to the present embodiment, each of the second ribs 92 is disposed more downstream in the conveyance direction 15 than the nozzle 39. As a result, the waveform shape along the left-right direction 9 in a portion facing the nozzle 39 of the sheet 12 can be formed by only the first rib 91. As a result, the waveform shape along the left-right direction 9 in the portion facing the nozzle 39 of the sheet 12 can be maintained in a constant shape.

Moreover, due to the present embodiment, each of the second ribs 92 is disposed with a spacing between it and each of the first ribs 91 in the conveyance direction 15. As a result, an area (first area 81A) of the platen 42 between the first rib 91 and the second rib 92 in the conveyance direction 15 can be utilized as an area impacted on by the ink droplet discharged to an outer edge part of the sheet 12 during the so-called borderless printing. In other words, the multifunction peripheral 10 according to the present embodiment can be configured as an apparatus capable of borderless printing.

Moreover, due to the present embodiment, a portion of a trough of the waveform shape in the sheet 12 is supported by the third rib 93, between the first rib 91 and the second rib 92 in the conveyance direction 15. As a result, adherence to the sheet 12 of ink that has impacted on the first area 81A between the first rib 91 and the second rib 92 in the conveyance direction 15, can be reduced during borderless printing.

Moreover, due to the present embodiment, each of the first ribs 91 and the downstream end 81 of each of the contacting members 81 cooperate to enable the sheet 12 to be given the waveform shape along the left-right direction 9. As a result, a stable waveform shape can be given to the sheet 12.

Modified Embodiments

Figure 7A:
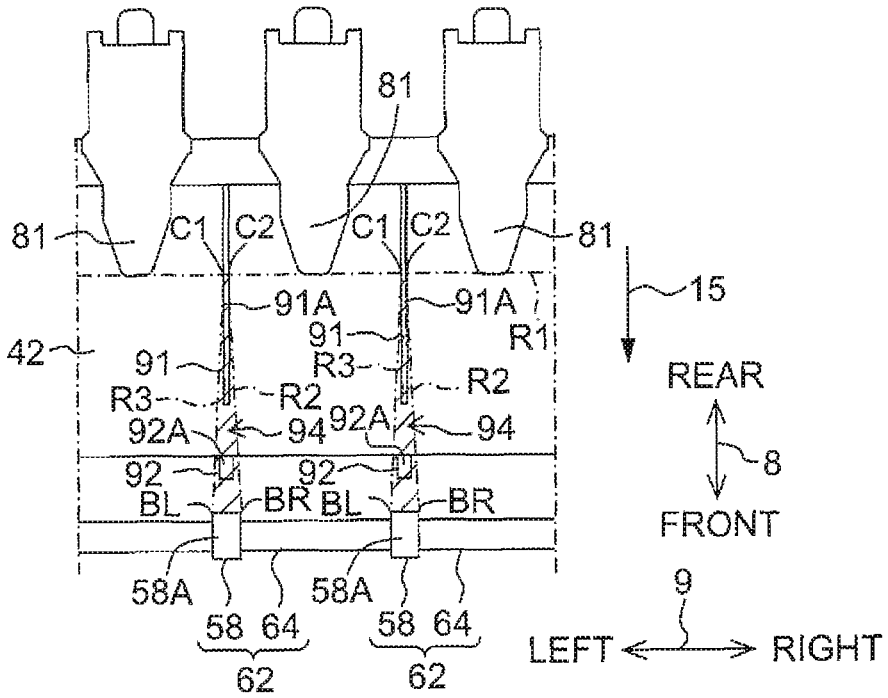

The length in the left-right direction 9 of the upper surface 92A of each of the second ribs 92 is preferably within an area 94 indicated by hatching in FIG. 7A. Now, the area 94 is an area surrounded by: a straight line R1 joining downstream edges in the conveyance direction 15 of each of the contacting members 81; a straight line R2 joining a rear right edge BR of each of the roller parts 58 of the discharge roller 62 and one of intersection point C1 of the straight line R1 and each of the first ribs 91; a straight line R3 joining a rear left edge BL of each of the roller parts 58 of the discharge roller 62 and one of intersection point C2 of the straight line R1 and each of the first ribs 91; and a rear edge of each of the roller parts 58.

Figure 7B:
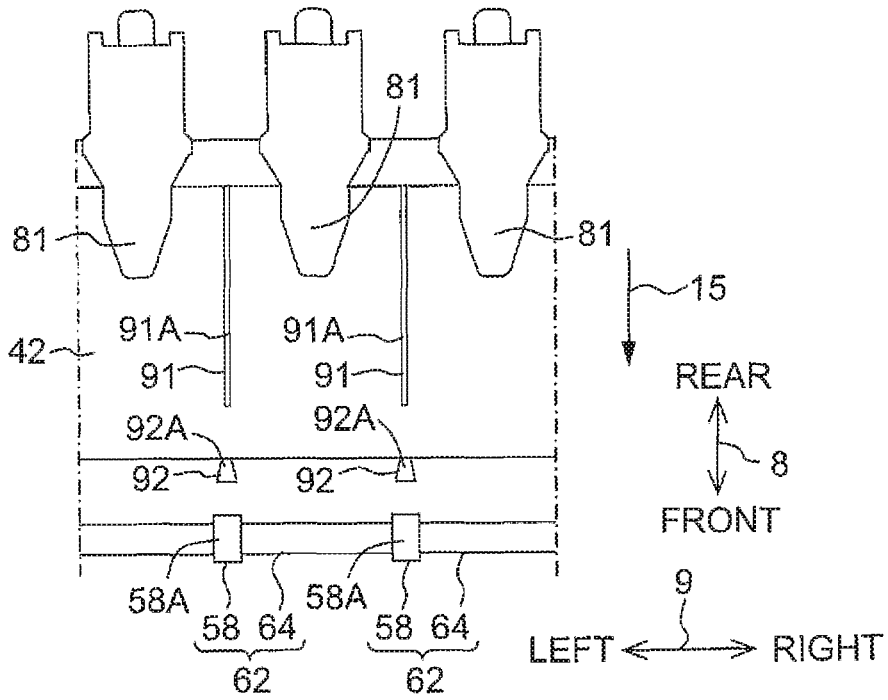

Moreover, as depicted in FIG. 7B, each of the second ribs 92 may be configured such that the length in the left-right direction 9 of its upper surface 92A becomes longer as progress is made downstream in the conveyance direction 15.

Due to the above-described modified embodiment, a gradual change accompanying progress downstream in the conveyance direction 15, of the waveform shape along the left-right direction 9 of the sheet 12 formed by each of the first ribs 91, can be made finer. As a result, loss of the waveform shape during entry to the roller part 58 of the sheet 12 can be reduced even more than in the above-described embodiment.

Figure 8A:
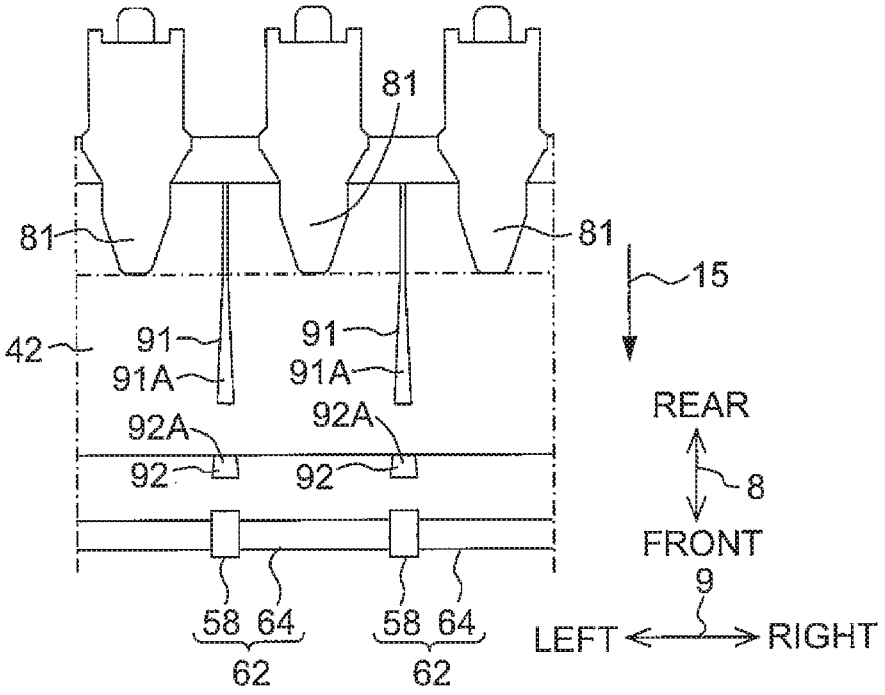

Moreover, as depicted in FIG. 8A, each of the first ribs 91, similarly to each of the second ribs 92, may also be configured such that the length in the left-right direction 9 of its upper surface 91A becomes longer as progress is made downstream in the conveyance direction 15.

Note that in FIGS. 7, 8A, and later-described 9, the third rib 93 is not depicted, but in the case of configurations depicted in FIGS. 7, 8A, and 9, presence/absence of the third rib 93 is arbitrary.

Figure 8B:
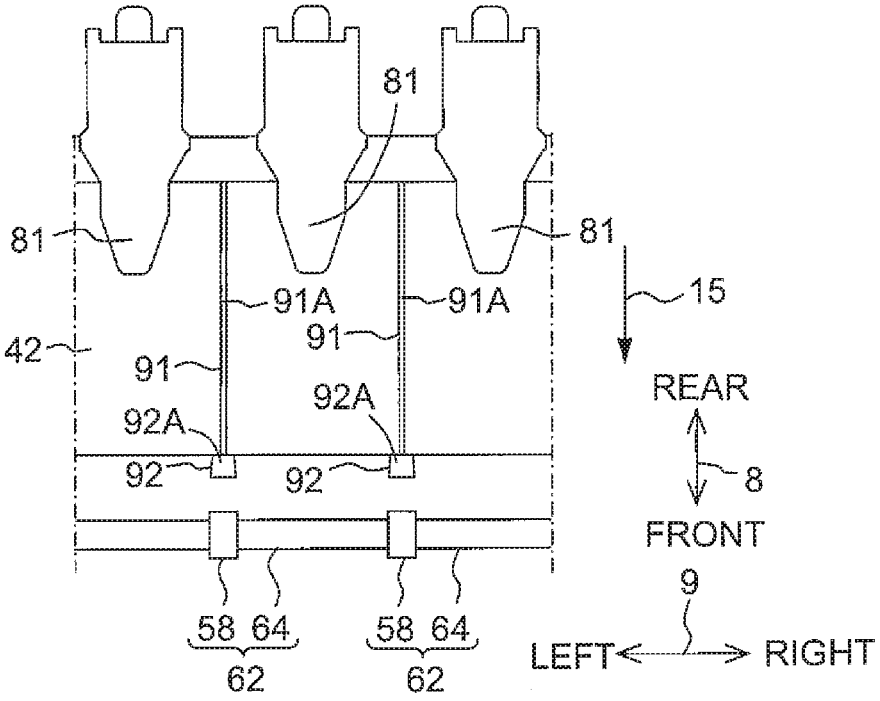

Moreover, in the above-described embodiment, each of the second ribs 92 was disposed with a spacing in the conveyance direction 15 between itself and each of the first ribs 91. However, as depicted in FIG. 8B, each of the second ribs 92 may be joined to each of the first ribs 91 in the conveyance direction 15.

Figure 9:
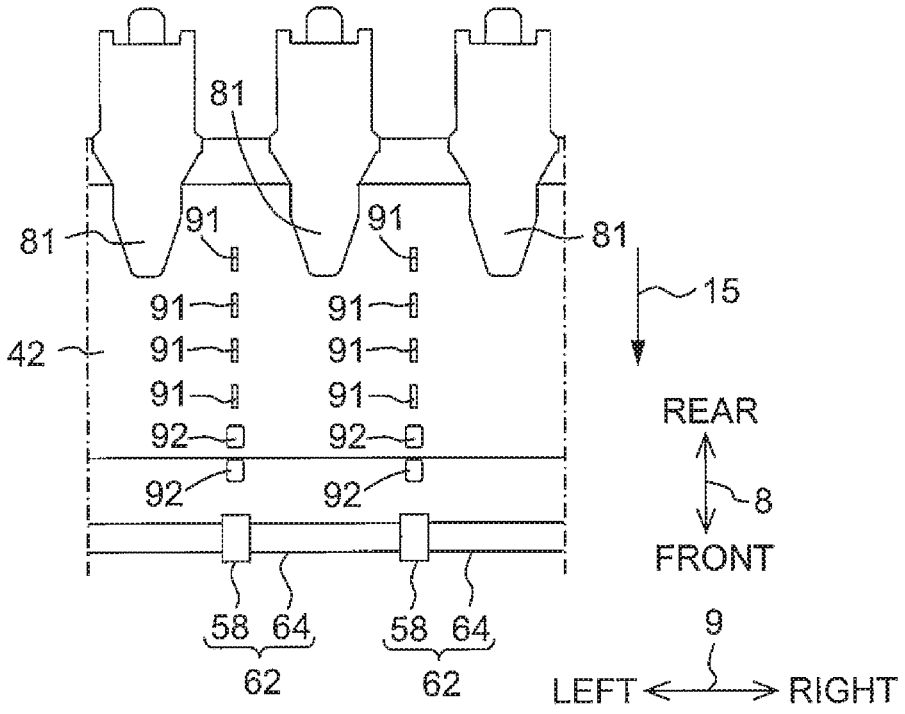
FIG. 9 is a plan view showing schematically the first rib 91, the second rib 92, the discharge roller 62, and the contacting member 81 in a modified example, and shows a configuration where the first rib 91 and the second rib 92 are pluralities of ribs disposed with a spacing between them in the conveyance direction 15.

In addition, as depicted in FIG. 9, the first rib 91 and the second rib 92 may be configured by a plurality of ribs disposed with a spacing between them in the conveyance direction 15. Note that when the platen 42 includes the third rib 93, the third rib 93 may also be configured by a plurality of ribs disposed with a spacing between them in the conveyance direction 15.

Moreover, in the above-described embodiment, the second rib 92 was provided in the platen 42. However, the second rib 92 may be provided in other than the platen 42, for example, in the downstream supporting portion 78.

Moreover, in the above-described embodiment, the discharge roller 62 was disposed more downwardly than the spur roller 63 in the discharge roller pair 44, but the discharge roller 62 may be disposed more upwardly than the spur roller 63. In this case, the surface 58A of each of the roller parts 58 of the discharge roller 62 abuts on the first surface of the sheet 12, and the tips of the teeth of the gear wheels configuring each of the spur rollers 63 abut on the second surface of the sheet 12, thereby enabling the discharge roller pair 44 to sandwich the sheet 12.

What is claimed is:

1. An ink-jet recording apparatus configured to discharge ink droplets onto a sheet, comprising:

a plurality of rollers configured to convey the sheet in a conveyance direction, the plurality of rollers being disposed so that each two adjacent rollers of the plurality of the rollers have a spacing therebetween in a width direction orthogonal to the conveyance direction;

a platen disposed more upstream in the conveyance direction than the plurality of rollers;

a recording unit disposed above the platen and configured to discharge the ink droplets from a plurality of nozzles toward the platen;

a plurality of first ribs provided in the platen, disposed so that each two adjacent first ribs of the plurality of first ribs have a spacing therebetween in the width direction, and each of the first ribs having a supporting surface for supporting the sheet; and a plurality of second ribs provided between the plurality of first ribs and the plurality of rollers in the conveyance direction, respectively, the second ribs disposed so that each two adjacent second ribs of the plurality of the second ribs have a spacing therebetween in the width direction, and each of the second ribs having a supporting surface for supporting the sheet, wherein at least parts of the plurality of rollers, the plurality of first ribs, and the plurality of second ribs overlap in the width direction, wherein a length in the width direction of each of the supporting surfaces of the plurality of second ribs is longer than a length in the width direction of each of the supporting surfaces of the plurality of first ribs, and is shorter than a length in the width direction of a sheet contacting surface of each of the plurality of rollers, wherein the plurality of second ribs are disposed more downstream in the conveyance direction than the nozzles, and wherein at least a part of the plurality of first ribs are located at positions facing the nozzles in an ink discharge direction.

2. The ink-jet recording apparatus according to claim 1, wherein the plurality of second ribs are disposed so that each set of adjacent first and second ribs have a spacing therebetween in the conveyance direction.

3. The ink-jet recording apparatus according to claim 2, wherein the platen includes a third rib provided between the plurality of first ribs and the plurality of second ribs in the conveyance direction and between adjacent second ribs adjacent in the width direction, and having a supporting surface for supporting the sheet, and the supporting surface of the third rib is positioned lower than the supporting surface of the first rib.

4. The ink-jet recording apparatus according to claim 1, further comprising a contacting section which is located more upstream in the conveyance direction than the nozzles and is provided between two adjacent first ribs in the width direction, the contacting section configured to contact, from above, the sheet supported by the first ribs.

5. The ink-jet recording apparatus according to claim 1, wherein the more downstream in the conveyance direction, the longer a length in the width direction of the supporting surfaces of the second ribs become.

6. The ink-jet recording apparatus according to claim 1, wherein each of the contacting surfaces of the plurality of rollers contacts on a same surface as a surface of the sheet abutted on by each of the supporting surfaces of the plurality of first ribs and the plurality of second ribs.

7. The ink-jet recording apparatus according to claim 4, wherein the supporting surface of each of the second ribs, when viewed from a direction orthogonal to the conveyance direction and the width direction, is disposed within an area surrounded by: a straight line R1 joining downstream edges in the conveyance direction of each of multiple ones of the contacting section; an upstream edge in the conveyance direction of each of the rollers; a straight line R2 joining one end, in the width direction, of the upstream edge in the conveyance direction of each of the rollers and an intersection point C1 of the straight line R1 and one of the first ribs; a straight line R3 joining the other end, in the width direction, of the upstream edge in the conveyance direction of each of the rollers and an intersection point C2 of the straight line R1 and one of the first ribs.

8. The ink-jet recording apparatus according to claim 1, wherein the plurality of first ribs extended in the conveyance direction from positions located more upstream in the conveyance direction than the nozzles.

9. The ink-jet recording apparatus according to claim 1, wherein the more downstream in the conveyance direction, the longer a length in the width direction of the plurality of first ribs become.

* * * * *